United States Patent [19]

Seitz, Jr. et al.

[11] 3,958,199

[45] May 18, 1976

[54] HIGH VOLTAGE RELAY PACKAGE

[75] Inventors: Michael Wesley Seitz, Jr., York; John Gilbert Berger, Elizabethtown, both of Pa.

[73] Assignee: AMP Incorporated, Harrisburg, Pa.

[22] Filed: Jan. 31, 1975

[21] Appl. No.: 546,158

[52] U.S. Cl. ..... 335/154; 335/5

[51] Int. Cl.[2] ..... H01H 1/66

[58] Field of Search ..... 335/4, 5, 151, 152, 335/154

[56] References Cited

UNITED STATES PATENTS

| | | | |
|---|---|---|---|
| 2,870,287 | 1/1959 | Corbitt et al. | 335/154 |
| 3,087,125 | 4/1963 | Scholefield | 335/5 |
| 3,204,058 | 8/1965 | Barton | 335/154 |
| 3,254,171 | 5/1966 | Freeland et al. | 335/152 |

*Primary Examiner*—George Harris
*Attorney, Agent, or Firm*—Gerald K. Kita

[57] ABSTRACT

A small size high voltage relay package for low voltage control of high voltage lines. The relay package includes a reed switch surrounded by a polytetrafluroethylene tube around which is wound a coil for operating the reed relay. The entire structure is positioned within a casing which is potted with a polyurethane potting material which also extends over the coils and into the space between the sleeve and relay to provide complete encapsulation. The system is capable of handling voltages in the vicinity of 20kv utilizing a 24 volt switching source.

4 Claims, 5 Drawing Figures

HIGH VOLTAGE RELAY PACKAGE

The invention relates to a high voltage relay package and, more specifically, to an encapsulated reed switch system of small dimension capable of controlling high voltages with a low voltage control source. This device can be mounted directly to a ground plane and it will operate under a wide range of environmental conditions.

The control of high voltage sources, and particularly the turning on and off of such sources requires large and bulky devices. Such devices not only consume a great deal of space but also are relatively expensive to produce. It is always the desire of the art to provide small packages which are capable of performing the functions of prior art large cumbersome devices at relatively small costs.

In accordance with the present invention there is provided a system which provides the desired advantages enumerated above. Briefly, in accordance with the present invention, there is provided a reed switch with etched polytetrafluoroethylene tubing therearound and a coil around the tubing, the entire mechanism, including switch, tubing and coil, being completed potted, even in the interior spaces. In addition, the entire system is located within a housing and is completely encapsulated and potted therein. The result is that a low voltage control can be provided for operation of the reed switch, the reed switch itself controlling voltages on the order of 1000 times that of the control voltage.

It is therefore an object of this invention to provide a high voltage relay package which is capable of controlling high voltages with a low voltage control source which has relatively small size and is relatively inexpensive to produce.

It is a yet further object of this invention to provide a high voltage relay package for control of high voltages with a low voltage control source which is relatively corona free.

The above objects and still further objects of the invention will immediately become apparent to those skilled in the art after consideration of the following preferred embodiment thereof, which is provided by way of example and not by way of limitation wherein.

Figure 1:
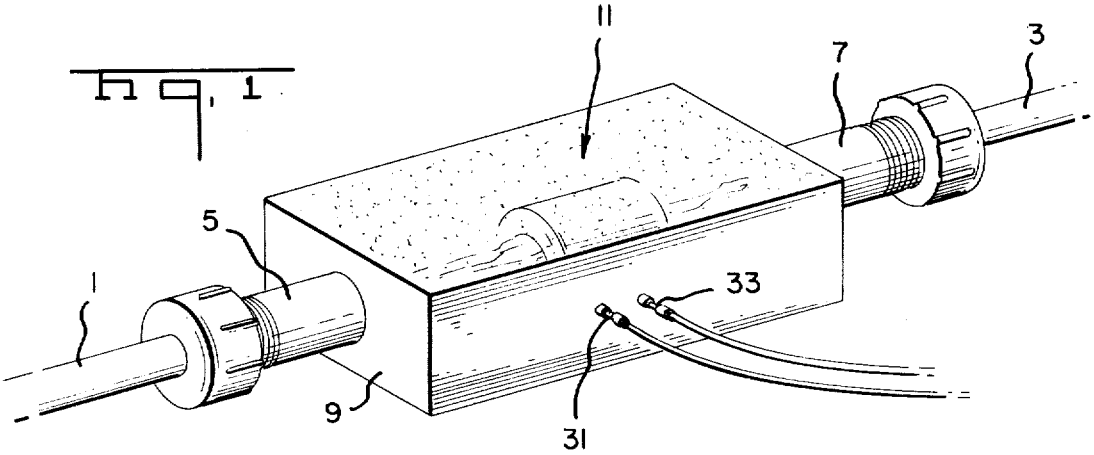
FIG. 1 is a view in elevation of the high voltage relay package in accordance with the present invention.
Figure 2:
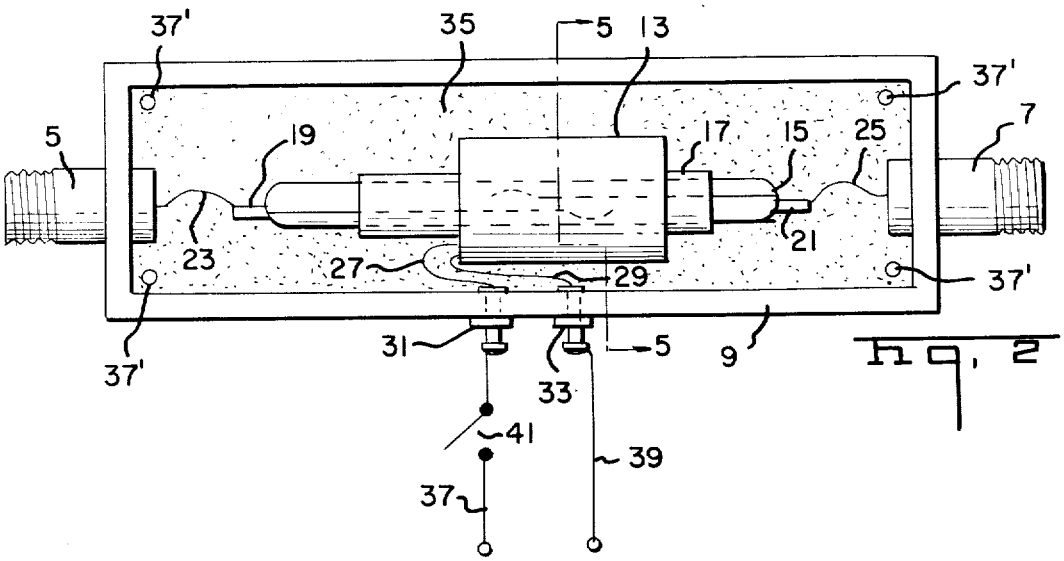
FIG. 2 is a cross-sectional view of the relay in accordance with the present invention.
Figure 5:
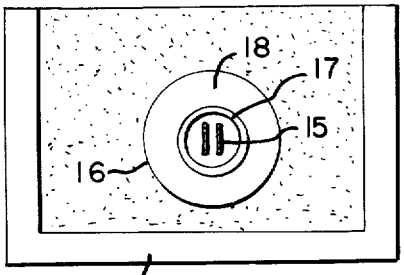
FIG. 5 is a view taken along the lines 5—5 of FIG. 2.

Referring now to FIGS. 1 and 2, there is shown the high voltage relay package in accordance with the present invention. A pair of high voltage leads 1 and 3 are connected via high voltage terminals 5 and 7 to the box 9 which includes the switch mechanism as will be explained hereinbelow. The high voltage leads 1 and 3 can be any well known leads such as, for example, leads made by AMP, Inc. under their trademark LGH and the mating high voltage terminals 5 and 7 can be any well known high voltage terminals such as, for example, made by AMP, Inc. under their trademark LGH terminals. The box 9 can be formed of any typical electrically insulating rigid material, many of which are well known in the art. The material should be a high impact material as well, such as, Epiall, manufactured by the General Electric Company. The top part of the box 9 is open as shown at 11 in FIG. 1, FIG. 2 being a top view and looking into the top of the box. Within the box is contained a magnetic reed switch 15 which has a glass housing. The switch 15 is surrounded by an etched plastic tubing 17, preferably formed of polytetrafluroethylene. A coil form 16, best shown in FIG. 5, is positioned about the tubing and a coil 13 is positioned around the coil form 16. Coil ends 18 are positioned at either side of the coil 13 to properly position same on the coil from 16. Leads 19 and 21 from the reed switch 15 are connected via leads 23 and 21 respectively to the high voltage terminals 5 and 7. The coil 13 is coupled via leads 27 and 29 to low voltage terminals 31 and 33 at the exterior of the box 9. The entire box 9 is filled with an encapsulating material, preferably polyurethane having a dielectric constant in the vicinity of about 5. The encapsulating material also should have the property of bonding to all of the surfaces within the box as well as the box itself. This prevents corona etching to planes of different potentials and is thus an important feature. In addition, it is desirable that the encapsulation take place in a vacuum so that the encapsulating material will fill all of the voids between the reed switch and the tubing as well as between the tubing and the coil. This allows the coil 13 to be isolated from the high voltage because it is possible to have current track back and hit the coil due to the difference in potential between the glass reed termination points and the margin of the coil. The tubing therefore also acts as an isolator. The low voltage source is coupled through lines 37 and 39 via a switch 41 to the terminals 31 and 33. The switch 41 can be a manual switch, a semiconductor or even be an optically controlled device.

Figure 3:
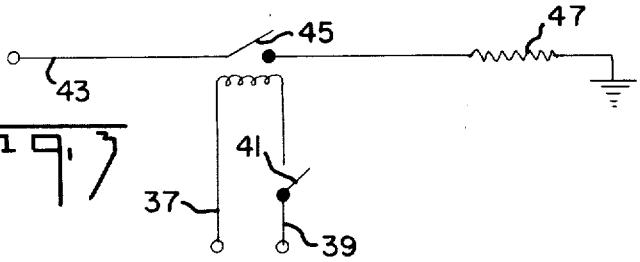
FIG. 3 is a first typical electrical circuit utilizing the high voltage relay package of FIGS. 1 and 2.

Referring now to FIG. 3 there is shown a first circuit utilizing the switch of FIGS. 1 and 2. It can be seen that the high voltage is received at terminal 43 and passes through the relay package 45 which is represented as a switch through a load 47 to ground. The relay 45 is operated by the application of a low voltage across lines 37, 39 and operation of switch 41.

Figure 4:
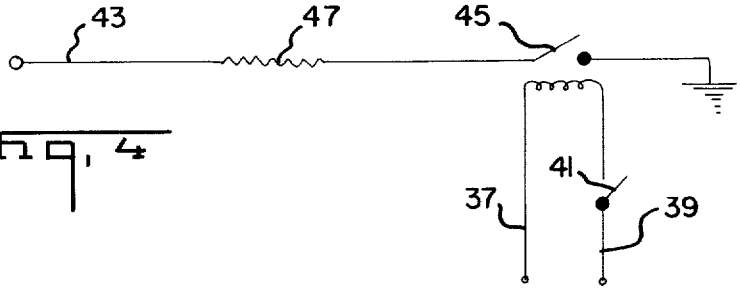
FIG. 4 is a second electrical circuit utilizing the high voltage relay package in accordance with the present invention.

With reference to FIG. 4, there is shown an alternative arrangement where the high voltage 43 first passes through the load 47 and then through the relay package 45 to ground.

It can be seen that there has been provided a relatively simple and small relay package of relatively low costs which is capable of controlling voltages in the kilovolt range with very low voltages of approximately one-one thousandth the value of the voltage being controlled.

Though the invention has been described with respect to a specific preferred embodiment thereof, many variations and modifications will immediately become apparent to those skilled in the art. It is therefore the intention that the appended claims be interpreted as broadly as possible in view of the prior art to include all such variations and modifications.

What is claimed is:

1. A high voltage relay comprising:

an electrically insulating housing, a reed switch positioned within said housing and having terminals coupled through said housing, an electrically insulating material surrounding said reed switch within said housing and bonded to said reed switch and said housing, low voltage means for operating said reed switch, an electrically insulating tube surrounding said reed switch, a coil form surrounding said tubing and a coil which is a part of said low voltage means formed on said coil form, said electrically conductive insulating material extending into the space between said reed switch and said tube and the space between said tube and said coil form and bonded to said tube, said coil form and said coil.

2. A high voltage relay as set forth in claim 1 wherein a tube is formed of etched plastic.

3. A high voltage relay as set forth in claim 1 wherein said electrically insulating material has a dielectric constant of about 5.

4. A high voltage relay as set forth in claim 2 wherein said electrically insulating material has a dielectric constant of about 5.

* * * * *